United States Patent [19]

Watanabe

[11] Patent Number: 5,009,407

[45] Date of Patent: Apr. 23, 1991

[54] SURGICAL TABLE FOR MICROSCOPIC LUMBAR LAMINECTOMY SURGERY

[76] Inventor: Robert S. Watanabe, 11645 Wilshire Blvd., Ste. 701, Los Angeles, Calif. 90025

[21] Appl. No.: 352,058

[22] Filed: May 15, 1989

[51] Int. Cl.[5] ..... A61G 13/00

[52] U.S. Cl. ..... 269/322; 269/328

[58] Field of Search ..... 269/322, 323, 324, 325, 269/328

[56] References Cited

U.S. PATENT DOCUMENTS

| | | | |
|---|---|---|---|
| 2,494,746 | 1/1950 | Colston | 269/325 |
| 2,577,177 | 12/1951 | Anderson | 311/5 |
| 2,622,950 | 12/1952 | Nimmo | 269/325 |
| 2,895,775 | 7/1959 | McDonald et al. | 311/5 |
| 3,353,820 | 11/1967 | Langren | 269/328 |
| 3,493,225 | 2/1970 | Ceraldi | 269/322 |
| 3,620,210 | 11/1971 | Annas | 269/322 |
| 3,652,851 | 3/1972 | Zaalberg | 269/322 |
| 3,843,112 | 10/1974 | McDonald | 269/322 |
| 4,391,438 | 7/1983 | Heffington, Jr. | 269/328 |
| 4,398,707 | 8/1983 | Cloward | 269/328 |
| 4,444,381 | 4/1984 | Wayne | 269/328 |
| 4,527,787 | 7/1985 | Collis, Jr. | 269/322 |

FOREIGN PATENT DOCUMENTS 882476 7/1949 Fed. Rep. of Germany ..... 269/325

OTHER PUBLICATIONS

Tables by Tower, Roger Anderson, copyright 1949.

*Primary Examiner*—J. J. Hartman

[57] ABSTRACT

A surgical table intended specifically for microscopic lumbar laminectomy surgery which may be quickly and conveniently adjusted to fit the needs of the individual patient, and by which the patient is properly positioned for the surgery in a matter of minutes. The table serves to hold the patient in the proper flexed position throughout the surgical procedure. The table includes a top which is supported on a frame base at its forward end by a post in a cantilever configuration, with the top being angularly adjustable about a horizontal axis and also about the vertical axis of the post, and with the post itself being adjustable to set the top to a desired elevation. For the procedure, the patient kneels on a support at the other end of the base with his upper torso extending over the table top to be supported on the top by his iliac crests and chest.

4 Claims, 3 Drawing Sheets

SURGICAL TABLE FOR MICROSCOPIC LUMBAR LAMINECTOMY SURGERY

BACKGROUND OF THE INVENTION

A lumbar laminectomy is a complex and delicate operation, with the possibility of complications such as excessive hemorrhage from the epidural veins, life-threatening injuries to retroperitoneal major blood vessels and tearing of spinal nerves or the dura.

Previous operating procedures for spinal operations called for placing the patient face-down in a horizontal position on a flat surgical table top. In this position, the greatest weight of the patient is supported primarily by the abdomen on the flat table top. Furthermore, the patient's knees are straight, and the legs extended. This has created two problems with which the spinal surgeon has had to contend, and which have an adverse, complicating effect on the surgical procedure. The first problem was that with the patient in the aforesaid position, it was difficult to control and minimize blood loss. As is well know, excessive loss of blood during an operation poses an immediate risk of harm to the patient, due to either the loss of blood itself, or the risk of hepatitis infection concomitant with any blood transfusion. Excessive bleeding at the operation site also obscures the operating field hindering the ability of the surgeon to see his work clearly.

Blood loss during a spinal surgical operation is a function of the degree of intraspinal venous engorgement. That is, whether the blood vessels in the spinal area are full and under pressure, or are drained. If the patient is positioned face-down on the operating table, as was the standard operating procedure in the prior art, the abdominal area supports a large portion of the patient's weight, as mentioned above. This, in turn, causes the viscera to be forced against the spinal column which results in intraspinal engorgement as the blood in the spinal area is retained there and the blood in the visceral area is forced into the spinal area.

Moreover, when the patient is lying face down on the surgical table with his knees straight and his legs extended, the spinal column is under a compressive load. For any operation on the spine, the surgeon prefers to have the spine in a flexed position, that is, in a relaxed state under no load.

Accordingly, it is important for a lumbar laminectomy that the patient be placed with the hips flexed at a right-angle in order to open up the back of the spine and allow for the surgical procedure with a minimum removal of bone from the laminar area. The patient's knees should be flexed to a 90° angle, and the weight of the patient is preferably supported by the iliac crests (hips) and also by the lower portion of the chest. This removes the pressure from the abdomen and decreases bleeding in th spine during the surgical procedure due to the decreased intra-abdominal pressure.

Because of the foregoing criteria, various attachments have been proposed to surgical tables, so that the patient may be placed in a more appropriate position for a spinal operation. Such attachments are described, for example, in Cloward U.S. Pat. No. 4,398,707 and in Wayne U.S. Pat. No. 4,444,381. However, such attachments are subject to certain disadvantages. In some instances, for example, the patient is held in an upright fetal position with the knees pulled forward to the chest. Although this does flex the spine, the patient is placed in a most uncomfortable position and free breathing is restrictive. Also, the viscera is forced against the spinal column so that blood loss is accelerated.

In all cases, where such attachments are used in conjunction with a regular operating table, up to an hour of valuable surgical time is lost in placing the patient in proper position on the table.

A surgical table is described in U.S. Pat. No. 4,712,781, which issued Dec. 15, 1987 in the name of the present inventor, which is constructed to achieve the criteria set forth in the preceding paragraph. The operating table described in U.S. Pat. No. 4,712,781 is a special lumbar surgical table which permits the patient to be positioned in the proper hip and knee 90/90 position in a matter of minutes. This position opens the posterior interlaminal area and minimizes the need for bone dissection of the lamina. The lack of pressure on the abdomen also minimizes bleeding from Batson's vein around the dura. The patient is suspended by the iliac crests and the xyphoid. The patient's head is closer to the anesthesiologist and provides for better monitoring during surgery. There is no pressure nor any acute flexion of the knees so that the venous system is not compromised and there is less danger of a post-operative thrombophlebitis.

In addition, the table described in U.S. Pat. No. 4,712,781 is constructed to permit the C-arm of a standard X-ray machine to be inserted through one side of the table to be directly under and over the patient so as to permit anterior/posterior (AP) as well as lateral X-ray to be taken. In this way, exact coordinates may be provided to the surgeon of the location of the area of the body to which the surgical procedure is to be directed.

An objective of the present invention is to provide an operating table which like the table described in U.S. Pat. No. 4,712,781 is particularly constructed for lumbar laminectomy surgery, and which enables the patient to be placed in the proper position in a manner of minutes.

Specifically, the table of the present invention achieves the same objectives as the table of U.S. Pat. No. 4,712,781 in that it allows for the rapid positioning of the patient for lumbar surgery. However, the table of the present invention is of a simpler construction than the table described in U.S. Pat. No. 4,712,781, and it provides for more convenient adjustability to fit the needs of the individual patients.

Like the surgical table of U.S. Pat. No. 4,712,781, the table of the invention is used in the microscopic lumbar laminectomy procedure and for spine surgical procedures where C-arm X-ray is necessary. The table of the invention particularly provides for the localization of the proper level in any type of lumbar surgery, and it is particularly useful in the pedicular screw fixation procedure, and especially in reconstructive and repeat surgical cases where the anatomy is obscured.

The surgical table of the invention supports the patient in the proper prone position with the torso supported by the iliac crests and the chest. The lumbar lordosis is eliminated, and the table allows easy access to the interlaminal area and places the pedicles in a vertical position for more accurate locatilization during surgery. The lack of pressure on the abdomen decreases the bleeding from the Batson's veins.

SUMMARY OF THE INVENTION

A surgical table is provided which is intended specifically for microscopic lumbar laminectomy surgery. The table includes a top which is supported on a frame base at its forward end by a post in a cantilever configuration. The top is angularly adjustable about the axis of the post in a vertical plane. The post itself is adjustable to set the top to a desired elevation. A support is provided at the other end of the base on which the patient kneels with his upper torso extending over the table top to be supported by the iliac crests (hips) and by the chest of the patient.

DETAILED DESCRIPTION OF THE ILLUSTRATED EMBODIMENT

Figure 1:
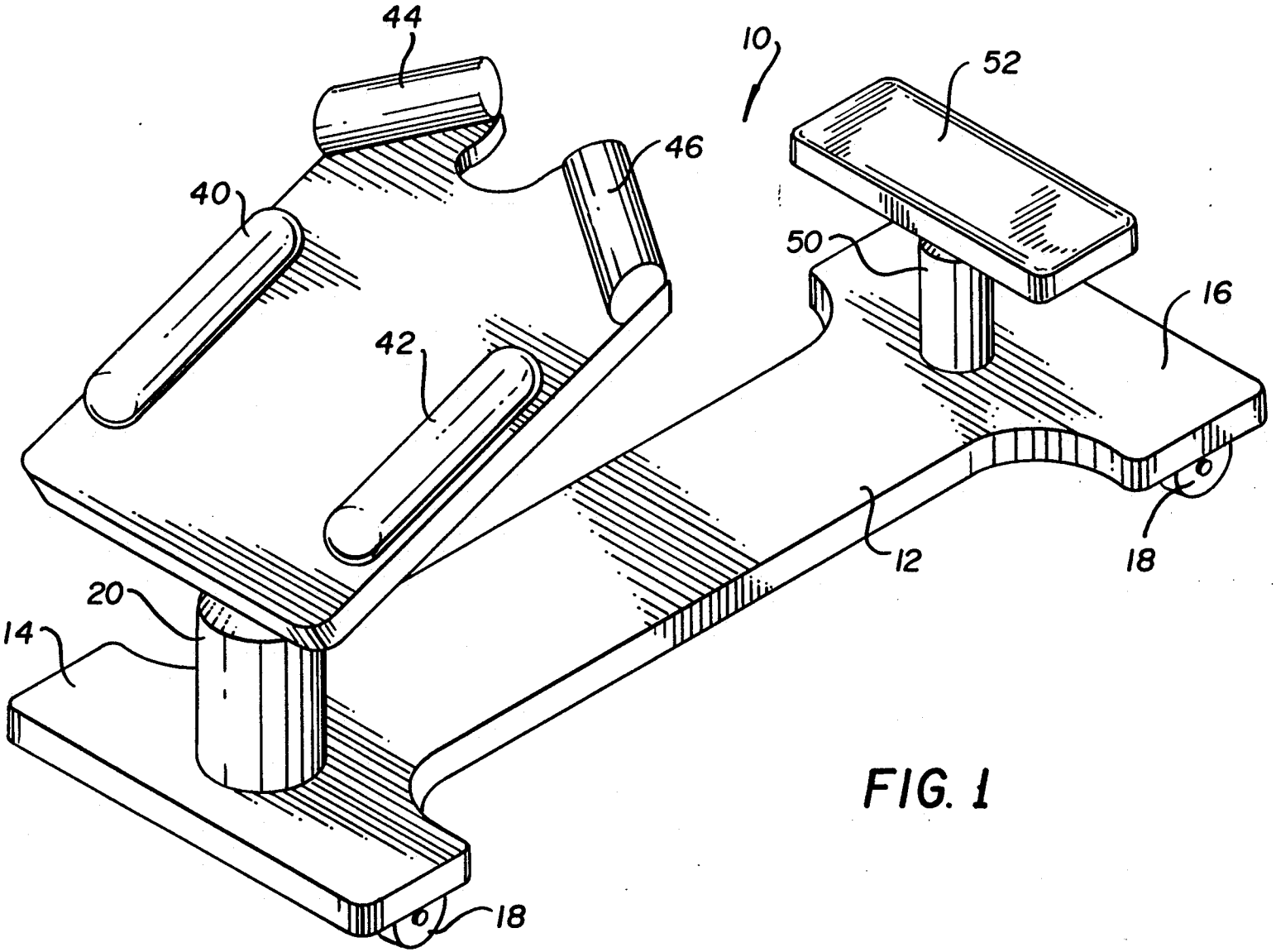
FIG. 1 is a perspective representation of the surgical table of the present invention in one of its embodiments.

The surgical table shown in the drawings is designated generally as 10. The table includes an elongated base 12 having a first end 14 and a second end 16. The base may be mounted on wheels 18 so that the table may be moved from one position to another in the operating room. The base 12, for example, may be 55 to 60 inches long, and may be 22 inches in width.

Figure 5:
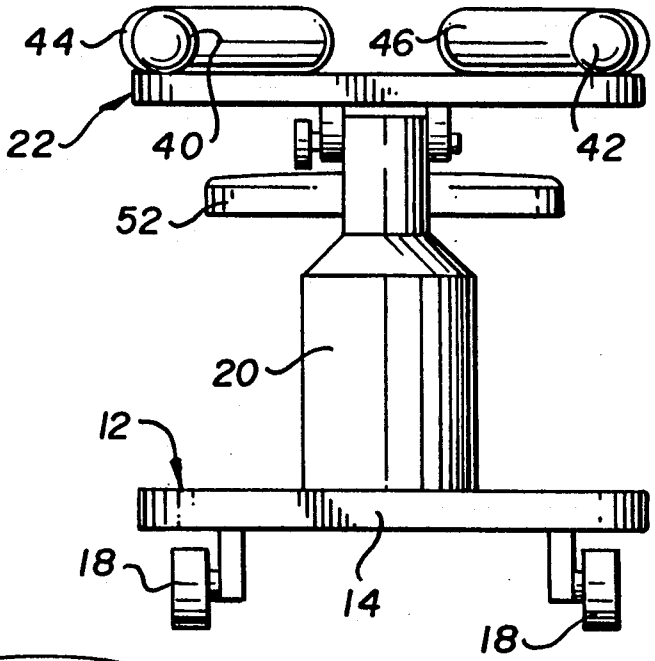
FIG. 5 is an end elevation of the surgical table of FIG. 1.
Figure 4:
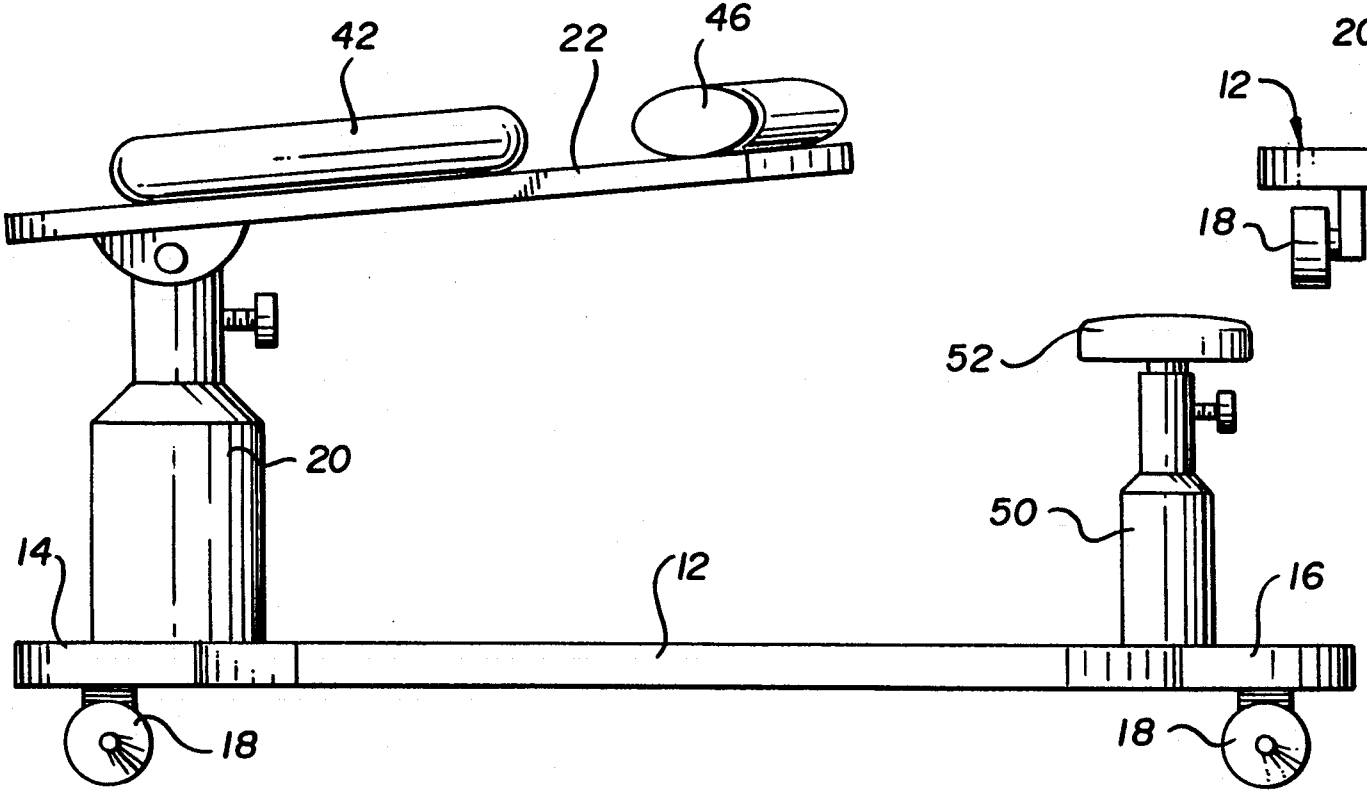
FIG. 4 is a side elevation of the surgical table of FIG. 1.

A post 20 is mounted at the first end 14 of the base, and extends upwardly from the base. A table top 22 is mounted as a cantilever on the post 20, to be supported by the post above the base 12 in a displaced relationship with the base. The table top is mounted on a shaft 21 (FIGS. 4 and 5) which extends through the post along a horizontal axis traversing the vertical axis of the post.

The table top 22 may be turned about the horizontal axis of shaft 21, and set in any desired angular position by a set screw 23, so that the patient may be supported in an optimum position during the surgical procedure. The table top, for example, may be adjustable through a 15° arc about the horizontal axis of shaft 21. The post 20 may, for example, be 30 inches in height, and table top 22 may be 36 inches long. The post 20 may be adjustable vertically to set the table 22 to a desired elevation by loosening or tightening a set screw 25.

Figure 2:
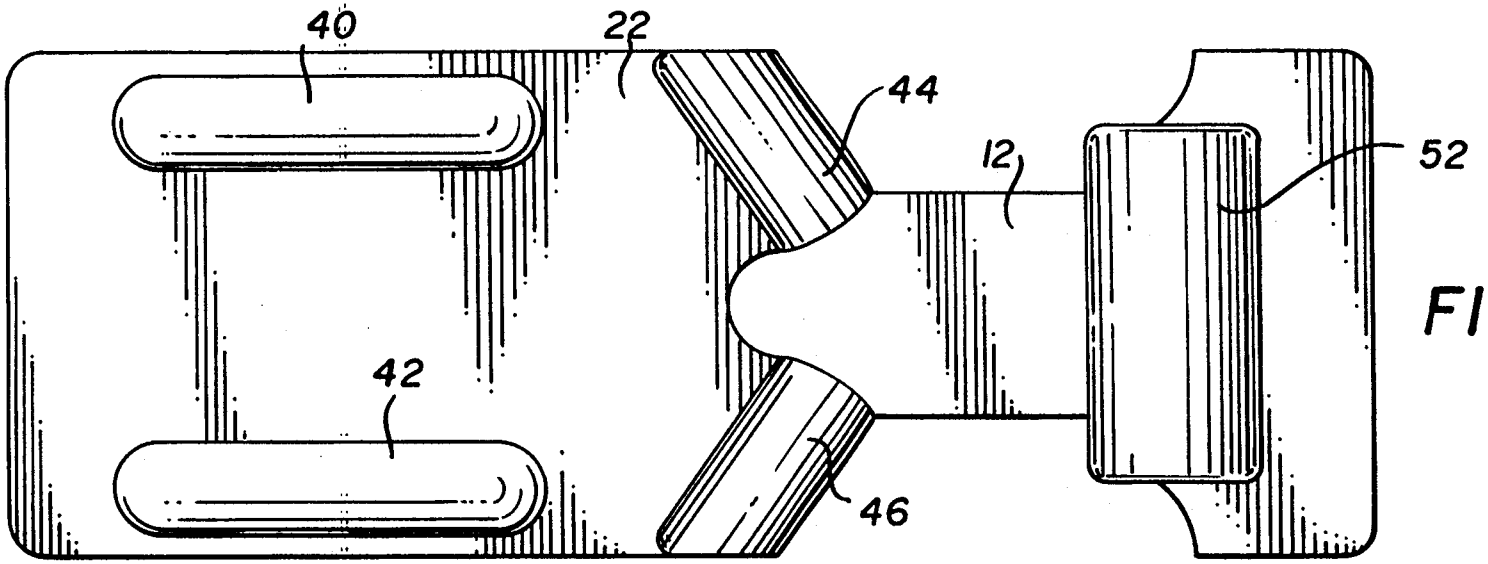
FIG. 2 is a top plan view of the surgical table of FIG. 1.

A pair of shoulder supports 40, 42 are mounted on table top 22, and a pair of iliac supports 44 and 46 are also mounted on the table top, as best shown in the perspective view of FIG. 1, and in the plan view of FIG. 2.

A post 50 is mounted at the second end 16 of the base 12, and a support 52 is mounted on the top of post 50. The support 52 may measure, for example, 12 inches by 20 inches, and post 50 may be 16 inches high. Post 50 may be adjustable.

The support 52 supports the legs of the patient, and holds the patient in a prone position with the upper end of his torso extending over the table top 22. In that position, the shoulders of the patient are supported by the shoulder supports 40 and 42 of FIGS. 1 and 2, and the iliac crests of the patient are supported by the supports 44 and 46.

Figure 3:
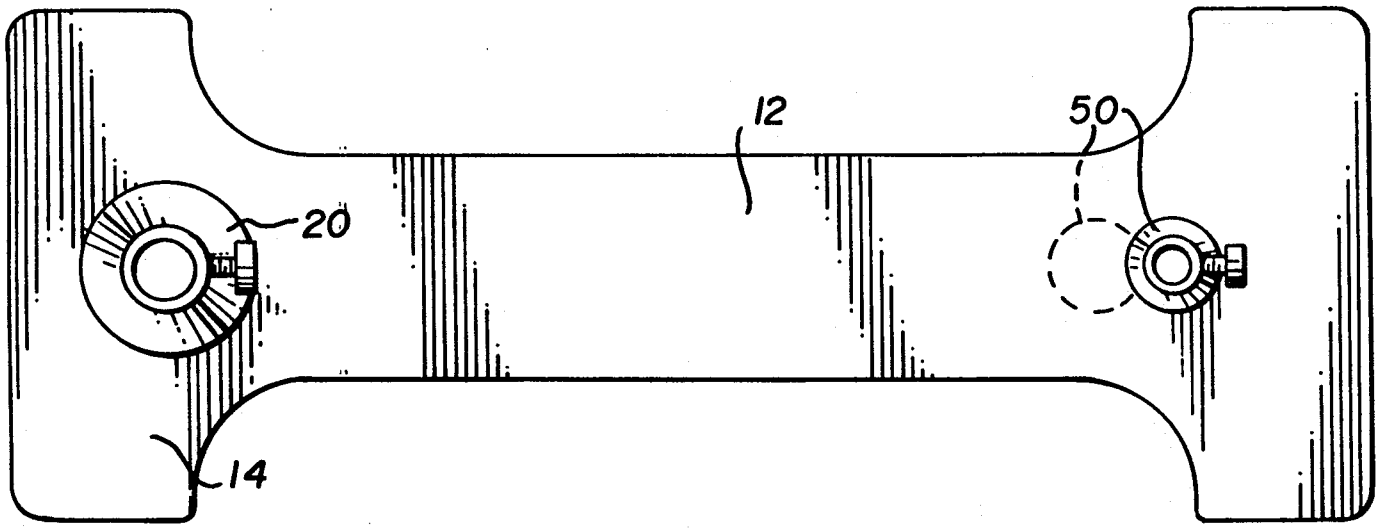
FIG. 3 is a top plan view of the base portion of the surgical table of FIG. 1.

Post 50 is also adjustable vertically along the base 12, as best shown in FIG. 3. In addition, the table top 22 may be adjustable about the vertical axis of the post 20 through, for example, an arc of 10°.

The invention provides, therefore, a surgical table which is particularly adapted for microscopic lumbar laminectomy procedures and for spine surgical procedures, for example, where C-arc X-ray apparatus is used.

The surgical table of the invention is simple in its construction, and it may easily be adjusted to fit the needs of the individual patient, and to hold the patient in the optimum position for the surgical procedures. As described above, the surgical table of the invention supports the patient in the proper prone position with the torso supported by the iliac crests and chest, so that lumbar lordosis is eliminated, and easy access to the interlaminal area is provided. In addition, the table of the invention places the pedicles in a vertical position for more accurate locatilization during surgery. Moreover, the lack of pressure on the abdomen decreases bleeding from the Batson's veins.

It will be appreciated that while a particular embodiment of the invention has been shown and described, modifications may be made. It is intended in the claims to cover all modifications which fall within the true spirit and scope of the invention.

I claim:

1. A surgical table for microscopic lumbar laminectomy, and spine surgical procedures, comprising: an elongated base having a first end and a second end; a first post mounted at the first end of said base and extending vertically upwardly from a horizontal plane of said base; a table top having a first end and a second end mounted on the upper end of said first post as a cantilever and supported at its first end by said post in an upwardly displaced position with respect to said base, said table top being angularly adjustable about a vertical ax of said first post and angularly displaceable relative to a second post mounted at the other end of said base and extending upwardly from the plane of said base; and a horizontal elongated leg support for the patient mounted on the upper end of said second post, longitudinally displaced from the second end of said table top and extending transversely with respect to the base said leg support being angularly adjustable about a vertical axis of said second post.

2. The surgical table defined in claim 1, and which include supports for the shoulders and iliac crests of the patient mounted on said table top.

3. The surgical table defined in claim 1, in which said first post is vertically adjustable to adjust the elevation of said table top.

4. The surgical table defined in claim 1, in which said second post is vertically adjustable to adjust the elevation of said leg support.

* * * * *